United States Patent [19]

Heller

[11] 4,079,663

[45] Mar. 21, 1978

[54] METHOD AND APPARATUS FOR FORMING A CARTON HAVING A PLASTIC BAG LINER

[76] Inventor: Wayne B. Heller, 4315 Cutler, Baldwin Park, Calif. 91706

[21] Appl. No.: 735,277

[22] Filed: Oct. 26, 1976

[51] Int. Cl.[2] ..... B31B 7/02

[52] U.S. Cl. ..... 93/36.01; 93/53 SD

[58] Field of Search ..... 93/36.01, 53 SD, 36.6, 93/84 FF; 53/175

[56] References Cited

U.S. PATENT DOCUMENTS

| | | | |
|---|---|---|---|
| 2,364,012 | 11/1944 | Walton et al. | 93/36.01 X |
| 3,074,325 | 1/1963 | Schroeder | 93/36.01 X |
| 3,144,816 | 8/1964 | Walker et al. | 93/36.01 |
| 3,147,675 | 9/1964 | Cherrin | 93/36.01 |
| 3,395,623 | 8/1968 | Baker | 93/36.01 |

*Primary Examiner*—James F. Coan

*Attorney, Agent, or Firm*—Lyon & Lyon

[57] ABSTRACT

Disclosed herein is a method and apparatus for forming corrugated cartons with plastic bag liners therein from conventional flat unformed cartons. The apparatus is comprised of an assembly for spreading the forward flaps of the cartons and pressing the flaps back onto the sides of the cartons; conveyor systems for continually bringing a carton and bag liner together such that the forward folded flaps of the carton are disposed within the bag; and a forming station where the cartons are opened into a rectangular configuration and a bag, a portion of which is disposed about and held by the folded flaps of the carton, is forced back through the carton whereupon the bottom flaps of the carton are folded into the closed position and sealed, thereby continually forming open ended corrugated cartons having plastic bag liners disposed about the interiors thereof.

13 Claims, 5 Drawing Figures

METHOD AND APPARATUS FOR FORMING A CARTON HAVING A PLASTIC BAG LINER

BACKGROUND OF THE INVENTION

In recent years, the increased costs of metal containers has forced the packaging industry to use corrugated cartons having plastic bag liners for packaging food products, perishables and other consumer commodities which have heretofore been packed in metal containers. While mechanical devices are known in the art and are used for forming corrugated cartons from flat unformed cartons, no satisfactory apparatus has heretofore been successfully developed for forming the carton with a thin interior plastic bag liner. Accordingly, it has been necessary to additionally employ numerous individuals whose sole function is to insert these liners in the cartons after they have been formed. This additional step significantly increases the costs of packaging these materials. It would be highly desirable to provide an apparatus capable of inserting the plastic bag liner within the carton during the formation of the carton and thereby eliminate the added expense of having to insert those bags by hand.

SUMMARY OF THE INVENTION

Briefly, the present invention comprises a method and apparatus by which a thin plastic bag is inserted into a corrugated carton during the formation of the carton. This is accomplished by folding the forward flaps of the carton back onto the sides of the carton, inserting the forward end of the carton including the rearwardly folded flaps into the bag whereupon the bag is held to the carton by the pressure exerted therein by the folded flaps. The carton is then opened into its rectangular disposition, the freely hanging portion of the plastic bag is forced back through the carton and the bottom flaps are sealed.

It is the principal object of the present invention to provide a method and apparatus for inserting a plastic bag into a corrugated carton during the formation of the carton.

This and other objects and advantages of the present invention will become apparent from the following detailed description taken in conjunction with the accompanying drawings.

DESCRIPTION OF THE PREFERRED EMBODIMENT

Figures 1, 2:
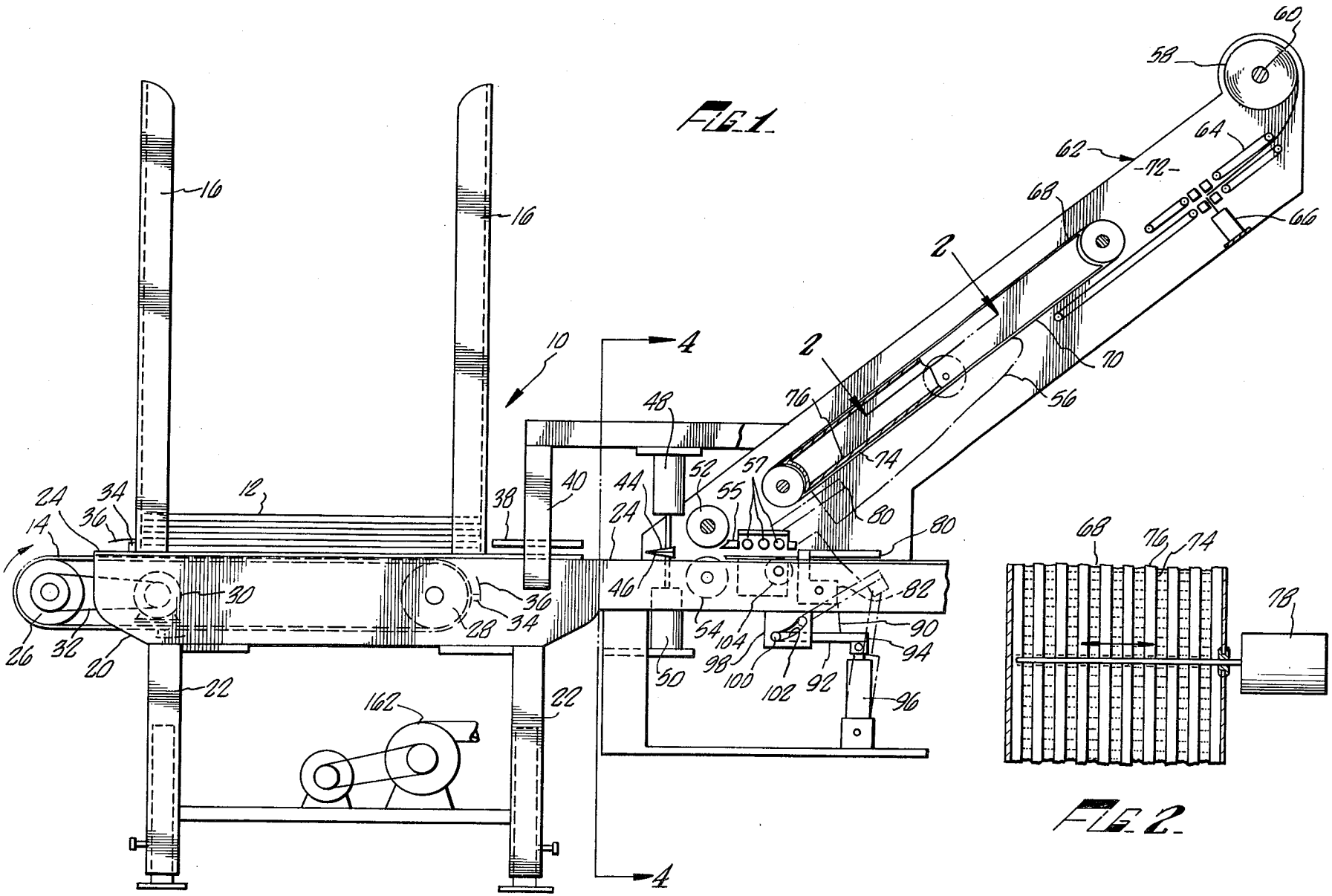
FIG. 1 is a partial side view illustrating that portion of the apparatus of the present invention by which the carton is inserted into the bag.
FIG. 2 is a sectional view taken along line 2—2 of FIG. 1.
Figure 5:
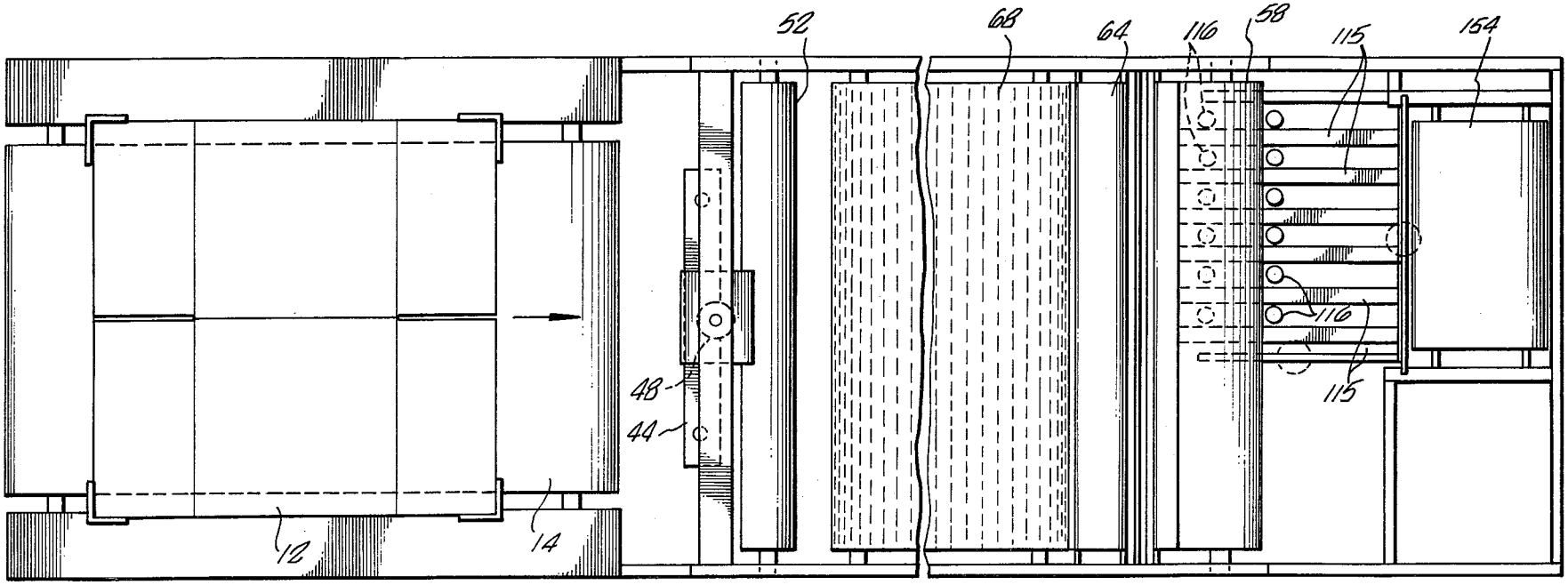
FIG. 5 is a top view of the carton conveying surface of the present invention.

Referring now in detail to the drawings, the apparatus 10 by which the cartons are formed and the interior liners are inserted therein is seen to be comprised of a first station illustrated in FIG. 1 wherein the cartons and bag liners are joined together and a second station immediately adjacent the first station, illustrated in FIG. 2, wherein the cartons are formed with the inner liners in place. Referring to FIG. 1, a stack of conventional collapsed corrugated cardboard cartons 12 are disposed on a conveyor 14 and held in place by four vertical positioning brackets 16. The cartons therein are oriented such that the top flaps 18 of the cartons fact to the right (see FIG. 5), i.e., the direction of movement. The conveyor 14 is carried by an extended frame 20 supported by adjustable legs 22 and is comprised of a support surface 24, drive rollers 26 and 28, drive motor 30, belt 32 and pusher dogs 34 which are secured to the belt for moving the cartons. The pusher dogs are each provided with a tail portion 36 which trails the pusher dogs and allows the next carton in the stack to be eased onto the conveyor when the bottom carton has been pushed forwardly without damaging the next carton.

A horizontal guide plate 38 is carried by the frame 20 by means of support 40 such that the plate is disposed a short distance over the horizontal support surface 24 of the frame so that a carton 12 upon being pushed thereunder by conveyor 14 is maintained in its flat disposition. A pair of wedge-shaped flap spreader plates 44 and 46 are mounted immediately adjacent each other to the right of guide plate 38 in the path of the carton on air cylinders 48 and 50. As a carton comes into contact with the spreader plates, the air cylinders 48 and 50 retract the plates causing the top flaps 18 to flare outwardly. As the carton continues to move and the spreader plates are further retracted, the flaps are folded back towards the sides of the carton until they reach an angle of about 60° therewith. As the carton is moved further to the right, the flaps contact compression rollers 52 and 54 which press the flaps a full 180° against the sides of the containers. The carton with its top or forward flaps so disposed is then moved by the conveyor 14 through a delivery guide 55 which is carried by the frame and includes a plurality or rollers 57 thereon.

Prior to the movement of a carton 12 from its position in the stack of cartons to the delivery guide 55, a thin plastic lining bag 56 is movedinto a carton receiving position at the downstream end of guide 55. A continuous roll 58 of lining bags is mounted on a hanger 60 above the bag delivery assembly 62 and the extended end thereof is fed through bag alignment assembly 64 and a cutting mechanism 66 which are mounted under a vacuum conveyor assembly 68. The conveyor assembly is comprised of an external perforated belt 70 against which each of the individual bags 56 severed from the roll 58 is held and by which they are transmitted to the carton receiving position; a vacuum chamber 72 having a plurality of longitudinal channels 74 extending therealong and through which air is drawn into the chamber; and a plurality of interconnected sealing plates 76 disposed within the vacuum chamber 72 and between channels 74. The plates are connected to an air cylinder 78 disposed outside the delivery assembly 62 such that upon actuation of the air cylinder 78 the plates are moved laterally into position over channels 74 thereby sealing the vacuum chamber and allowing a liner bag 56 being carried thereby to fall from the belt 70.

Figure 4:
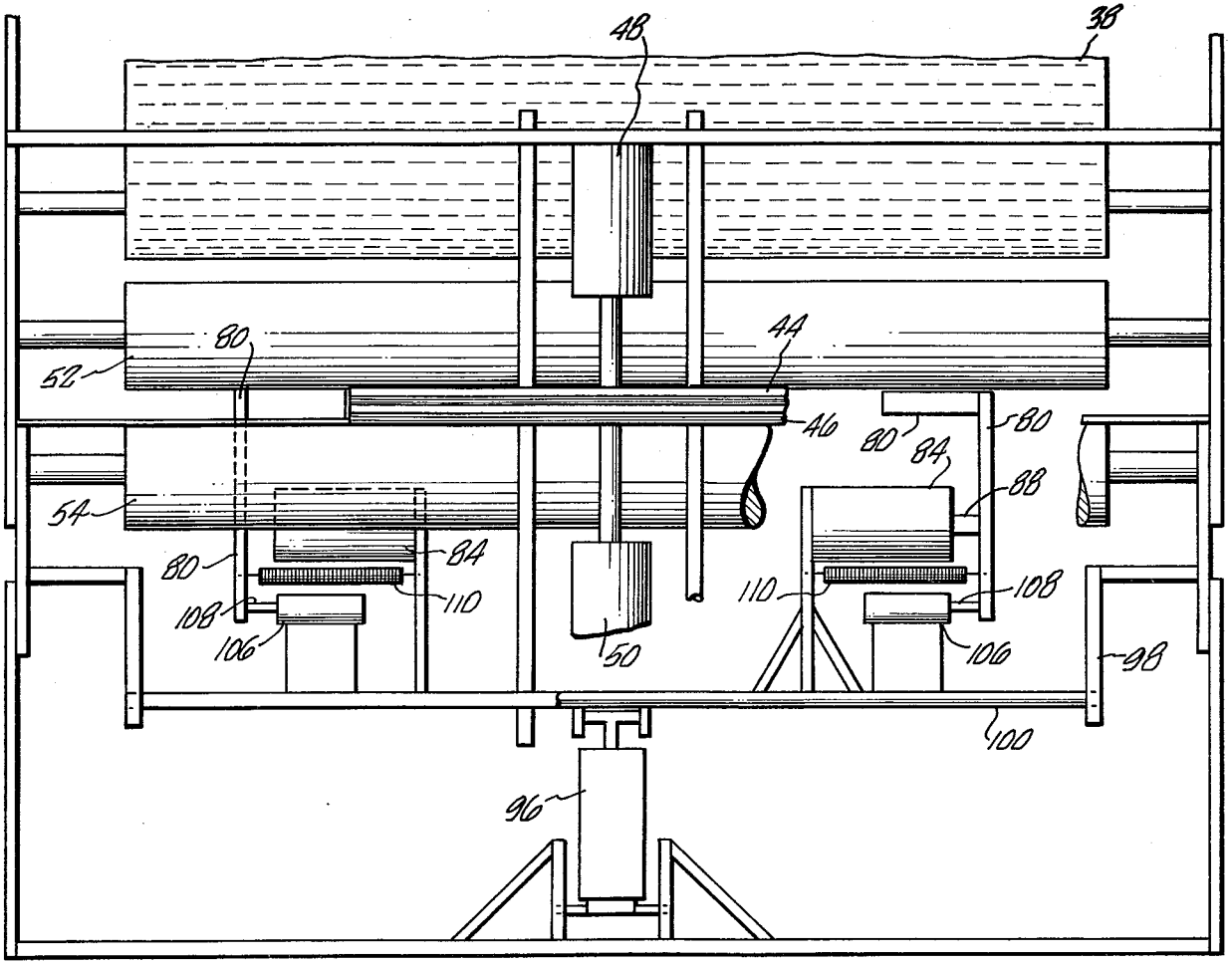
FIG. 4 is an end view of the tension arm elevating and spreading mechanisms.

A pair of bag retention arms 80 are mounted on the frame 20 for elliptical movement to engage a lining bag 56 carried by the vacuum conveyor assembly 68 prior to the bag being released therefrom. In the preferred embodiment of the invention illustrated in the drawings, each of the arms 80 is substantially L-shaped extending from an integrally formed bracket portion 82. The bracket portions of the arms are secured to air cylinders 84, see FIGS. 1 and 4, by shafts 88 and are supported on braces 90. Each brace is in turn mounted on an arm 92 which is secured at one end 94 to an air lift cylinder 96 and at the other to a bracket 98 by pin 100, the bracket 98 having a curved slot 102 in which said pin is disposed. Upon energizing the lift cylinder 96, the bag retention arms are raised to the position illustrated in dotted lines in FIG. 1 passing outside rollers 57 to avoid contact therewith. As only the upper surface of the lining bag is held against the perforated belt 70 of the vacuum conveyor, the lower end hangs free allowing the bag to receive the retention arms 80 as illustrated in FIG. 1. Having elevated the bag retention arms 80 to the bag receiving portion and the vacuum conveyor assembly 68 advancing a lining bag 56 about 6 inches over the retention arms 80, air cylinders 84 are energized causing the retention arms to move outwardly against opposite interior sides of the lining bag. At this point, the suction of the vacuum conveyor assembly is broken by activation of air cylinder 78 causing sealing plates 76 to cover the air channels 74 in the wall of the vacuum chamber. The bag is then released from the vacuum conveyor assembly and held solely by the retention arms 80. The air is then bled from the air lift cylinders 96 causing the retention arms and the lining bag carried thereby to return to a horizontal position whereupon the lining bag is in position to receive a carton 12.

Upon a lining bag being so positioned, the conveyor 14 is activated to advance a carton 12 from the stack as described above, i.e., under the guide plate 38 between the spreader plates 44 and 46 and compression rollers 52 and 54, through the delivery guide 55 and into the lining bag 56 helt taut by the retention arms 80. The carton is advanced into the bag by the conveyor 14 a distance such that the folded back top flaps 18 are disposed completely within the lining bag. At this point, the carton 12 has advanced beyond the control of conveyor 14 and is subsequently moved onto a second horizontal conveyor 104 by the compression rollers 52 and 54 which, together with guide rollers 57, are driven by means (not shown) and maintain the flat disposition of the carton as it advances to the second station where it enters the lining bag.

Prior to advancement of the carton into the lining bag by the compression rollers 52 and 54 and onto conveyor 104, it is necessary to relieve the tension exerted by the retaining arms 80 on the bag so that the bag can be carried solely by the force exerted thereon by the folded flaps of the carton pressing outwardly against the interior of the bag. To effectuate this result, a pair of secondary air cylinders 106 which are disposed below air cylinder 84 (see FIG. 4) are activated to extend shafts 108 outwardly therefrom but short of the retention arms 80 by about $\frac{3}{8}$ to $\frac{1}{2}$ inch. Coil springs 110 extend between braces 90 and the retention arms 80 such that upon bleeding the air from cylinders 84, the retention arms are drawn by the springs 110 inwardly against the shafts 108 extending from the secondary air cylinders, thereby relieving tension exerted by the retaining arms on the interior of the lining bags. With the tension being so relieved, while the retaining arms are still disposed within the lining bags, the bag is now effectually carried solely by the folded flaps 18 of the carton 12.

Figure 3:
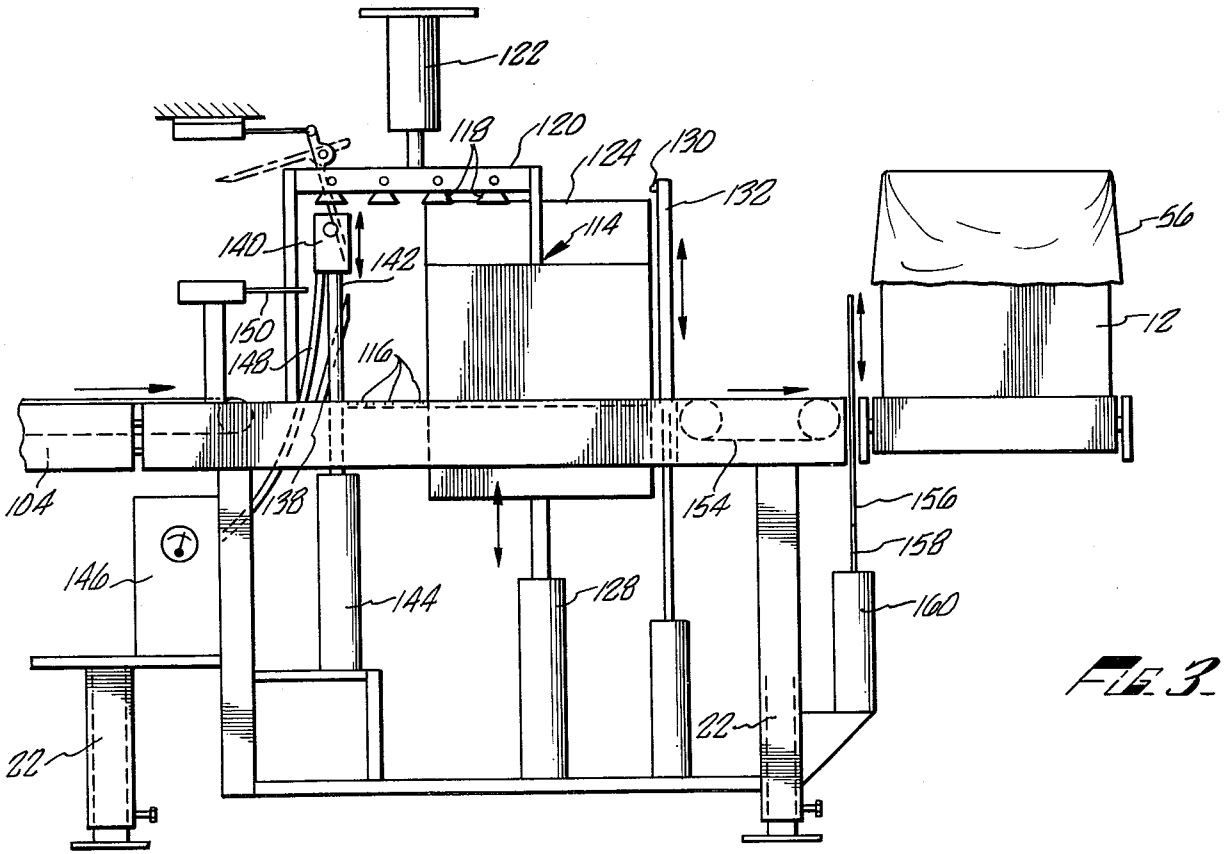
FIG. 3 is a partial side view of the apparatus fo the present invention illustrating the carton forming section.

Upon the carton flaps 18 being inserted into the lining bag and the tension in the retaining arms 80 relaxed, the carton 12 and the lining bag 56 are advanced by conveyor 104 to the forming station illustrated in FIG. 3.

As the carton reaches the forming station, generally designated 114, the next carton in line is advanced from the stack by the conveyor 14 so that the forming process is continuous. The lead carton 12 is held at the forming station by a plurality of vacuum cups 116 which are disposed on the left side of the support surface 42 of frame 20 between supporting bars 115, as viewed from above (see FIG. 4), under the corresponding side of the carton, behind (to the left of) and out of contact with the lining bag 56. A second plurality of vacuum cups 118 are mounted in a transient arm 120 for movement at an angle of about 45° down onto the right side trailing edge of the carton 12, again, behind and out of contact with the lining bag. The movement of the transient arm 120 and vacuum cups 118 is directed by an air cylinder 122. The carton is erected by drawing a vacuum on the cups 118 to grip the carton and returning the transient arm 120 to its raised position whereby the right side of the carton is raised above the left side which is held in place by the lower vacuum cups 116. In order to square the carton, an upright side panel 124 is disposed along one side of the frame 20 which is immediately adjacent one side of the carton. A second side panel 126 carried by a lifting cylinder 128 is then elevated into position immediately adjacent the opposite sidewall of the carton, squaring the carton.

Upon squaring the carton 12, the lining bag 56 which is being held by the forward flaps of the carton and disposed thereacross is uniformly blown by an air jet 130 back through the interior of the carton. The air jet 130 is mounted on a plate 132 extending from an air lift cylinder 134. As the plate 132 is raised by air lift cylinder 134, the air jet is activated, uniformly distributing the air flow throughout the interior of the carton, blowing the lining bag 56 back against the four interior walls of the carton. While the air jet 130 is raised, the carrying plate 132 is positioned immediately adjacent the open front end of the carton. The carton is now held fast between the two side panels 124 and 126 and plate 132. The upper and lower flaps of the trailing end of the carton are then closed by a pair of air actuated knife blades 136 and 138. Glue is then sprayed onto the two trailing bottom side flaps from a glue head 140 which is mounted on a shaft 142 extending from air lift cylinder 144 such that the glue can be applied along the entire length of the open flaps. In applying the glue to the open flaps, the glue head is initially raised and sprays the glue while air is bled from the supporting cylinder 144 to avoid premature setting of the glue, as in the preferred embodiment of the invention, a hot melt glue system is used wherein the glue is pumped from a cooker 146 to the glue head 140 through a conduit 148. In addition, this procedure allows the glue head upon its return to its lowered position to activate a second pair of air actuated knife blades 150 (only one being shown) which close the two open bottom flaps against the previously closed flaps thereby sealing the bottom of the carton.

Upon sealing the bottom end of the carton 12, the carton is advanced by a third horizontal conveyor 154. A lifting plate 156 is mounted on a shaft 158 extending from an air cylinder 160 is activated causing the plate to raise and thereby tilt the carton into an upright position from which the carton with the liner bag 56 therein can be advanced to a product filling station.

To activate the various air lift cylinders employed in the present invention in the proper timing sequences, several different systems can be employed. For example, photo cells with time delay units can be used to timely activate air solenoids. Alternatively, with the recent developments in manufacturing printed circuits, circuit boards could be utilized to provide the proper timing sequences. A squirrel cage blower 162 (see FIG. 1) is employed to operate the vacuum cups 117 and 118 and the vacuum conveyor assembly 68, while the factory air supplied from various lines (not shown) provide the necessary air for the various lift cylinders.

Various changes and modifications may be made in carrying out the present invention without departing from the spirit and scope thereof. Insofar as these changes and modifications are within the purview of the appended claims they are to be considered as part of the invention.

I claim:

1. An apparatus for forming a carton with a bag liner therein comprising means for inserting one end of said carton in a collapsed disposition into said bag liner, means for directing that portion of said bag liner extending from said end of said carton back through the interior of said carton and means for sealing the other end of said carton to define a carton having an open end, a closed end and a bag liner therein.

2. An apparatus for forming a carton with a bag liner therein comprising means for inserting one end of said carton in a collapsed disposition into said bag liner whereby said bag liner is held by said end of said carton, means for erecting said carton, means for directing that portion of said bag liner extending from said one end of said carton back through the interior of said carton and means for sealing the other end of said carton to define a carton having an open end, a closed end and a bag liner therein.

3. The combination of claim 2 wherein said carton has a flap portion extending from each end of each side thereof and including means for folding each of said flap portions disposed at said one end of said carton outwardly from said one end and back toward the exterior side of said carton from which said flap extends prior to inserting said one end of said carton into said bag liner whereby upon inserting said one end of said carton within said bag liner said bag liner is held by the folded flaps.

4. The combination of claim 2 wherein said carton insertion means comprises a bag retention assembly, means for advancing a bag liner onto said bag retention assembly and releasing said bag liner such that said bag liner is held by said bag retention assembly, means for advancing said carton, and means for moving said bag retention assembly to position said bag liner carried thereby such that said advancing means advances said end of said carton into said bag liner.

5. An apparatus for forming a carton with a bag liner therein from a collapsed carton of the type having a flat portion extending from each end of each side thereof, said apparatus comprising a bag retention assembly, means for advancing a bag liner onto said bag retention assembly, means for folding each of the flap portions disposed at one end of said carton outwardly from said one end back toward the exterior side of said carton from which said flap extends, means for advancing said carton, means for moving said bag retention assembly to position said bag liner carried thereby such that said advancing means advances said one end of said carton into said bag liner, means for erecting said carton, means for directing that portion of said bag liner extending from said one end of said carton back through the interior of said carton, and means for sealing the other end of said carton to define a carton having an open end, a closed end and a bag liner therein.

6. The combination of claim 5 wherein said directing means comprises an air jet assembly for directing an air flow into the interior of said carton and means for moving said assembly across said one end of said carton such that said air flow is uniformly distributed into the interior of said carton, blowing said bag liner back through the interior of said carton.

7. The combination of claim 5 wherein said folding means comprises a pair of spreader plates disposed in the path of said carton as said carton is advanced by said advancing means for flaring said flaps outwardly from said one end and a pair of compression rollers disposed in the path of said carton such that upon said flaps being flared by said spreader plates, said flaps are pressed back against the exterior sides of said carton from which said flaps extend.

8. The combination of claim 7 wherein said spreader plates are adjacently mounted such that said plates extend between said flaps as said carton begins to advance thereover and including means for separating said spreader plates as said carton passes thereover thereby flaring said flaps outwardly from said one end.

9. A process forming a carton with a bag liner therein comprising the steps of inserting one end of the carton in a collapsed disposition into said bag liner, directing that portion of said bag liner extending from said end of said carton back through the interior of said carton and sealing the other end of said carton to define a carton having an open end, a closed end and a bag liner therein.

10. The process of claim 9 wherein said carton has a flap portion extending from each end of each side thereof and including the additional step of folding each of said flap portions disposed at one end of said carton outwardly from said one end and back toward the exterior side of said carton from which said flap extends prior to inserting said one end of said carton into said bag liner.

11. A process for forming a carton with a bag liner therein comprising the steps of inserting one end of said carton in a collapsed disposition into said bag liner whereby said bag liner is held by said end of said carton, erecting said carton into a substantially squared disposition, directing that portion of said bag liner extending from said one end of said carton back through the interior of said carton and sealing the other end of said carton to define a carton having an open end, a closed end and a bag liner therein.

12. The process set forth in claim 11 wherein said carton has a flap portion extending from each end of each side thereof and including the additional step of folding each of said flap portions disposed at one end of said carton outwardly from said one end and back toward the exterior side of said carton from which said flap extends prior to inserting said one end of said carton into said bag liner.

13. A process for forming a carton with a bag liner therein from a collapsed carton of the type having a flap portion extending from each end of each side thereof, said process comprising the steps of holding a liner bag in an open disposition, folding each of the flap portions disposed at one end of said carton outwardly from said one end back toward the exterior of said carton from which said flap extends, advancing said one end of said carton into said bag liner a distance such that the folded flaps are disposed within said liner, erecting said carton into a substantially squared disposition, directing that portion of said bag liner extending from said one end said carton back through the interior of said carton and sealing the other end of said carton to define a carton having an end, a closed end and a bag liner therein.

* * * * *